US005549297A

United States Patent [19]

Mahaffey

[11] Patent Number: 5,549,297

[45] Date of Patent: Aug. 27, 1996

[54] GOLF CLUB IRON WITH VIBRATION DAMPENING RAMP BAR

[76] Inventor: Steven J. Mahaffey, 357 Glendale Rd., Hampden, Mass. 01036

[21] Appl. No.: 503,571

[22] Filed: Jul. 18, 1995

[51] Int. Cl.[6] ..... A63B 53/04

[52] U.S. Cl. ..... 473/290; 473/350

[58] Field of Search ..... 273/167 R, 77 R, 273/77 A, 167 F, 171, 172, 173, 175, 167 H, 169

[56] References Cited

U.S. PATENT DOCUMENTS

| | | | |
|---|---|---|---|
| D. 327,720 | 7/1992 | Antonious | D21/220 |
| 4,826,172 | 5/1989 | Antonious | 273/169 |
| 4,938,470 | 7/1990 | Antonious | 273/169 |
| 5,026,056 | 6/1991 | MacNally et al. | 273/77 A |
| 5,048,834 | 9/1991 | Gorman | 273/167 F |
| 5,048,835 | 9/1991 | Gorman | 273/167 F |
| 5,290,032 | 3/1994 | Fenton | 273/169 |
| 5,328,184 | 7/1994 | Antonious | 273/169 |
| 5,395,113 | 3/1995 | Antonious | 273/169 |
| 5,435,559 | 7/1995 | Swisshelm | 273/167 H |

*Primary Examiner*—Sebastiano Passaniti
*Attorney, Agent, or Firm*—Laubscher & Laubscher

[57] ABSTRACT

A golf club iron comprising a shaft, a head having a sole, a toe end, and a heel end. The head comprises a striking face and a cavity in the back portion. A vibration dampening ramp bar extends from the lower edge of the cavity and terminates at its lower end short of the upper edge of the cavity with the ramp bar being offset from the center of gravity of the club head. In a set of irons, the distance between the center of the lower end of the ramp and the toe of the iron increases as the loft of the club head increases.

5 Claims, 1 Drawing Sheet

GOLF CLUB IRON WITH VIBRATION DAMPENING RAMP BAR

This invention relates to golf clubs of the iron type, and more particularly to golf clubs having cavities within the backs thereof.

One of the types of golf clubs used today includes irons which have what is termed a "cavity back," where the back or the side opposite the striking face of the iron includes a substantially depressed area or cavity in the club. This particular design results in a relatively thin face when compared to the thicker-faced traditionally designed iron.

It has been observed that if golfers mishit an iron shot, they generally tend to mishit the difficult-to use longer irons more toward the toe of the club base than they do the more easily-handled short irons.

It has also been noted that cavity back irons produce a less solid feel due to the thin face design when compared to the thicker-faced traditionally-designed irons.

It is desirable to maintain the center of gravity of each club in the approximate center of the club striking face for maximum transfer of energy to the ball from a shot well struck in this area. While this is a desirable attribute of the clubs, it was found there is a need to limit the harsh vibration which occurs off the center of gravity when shots are mishit, particularly toward the toe.

U.S. Pat. No. 5,290,032, issued Mar. 1, 1994, and assigned to the assignee of the present application, addresses this vibration problem. Vibrations were successfully reduced through the use of a bar extending between the lower and upper edges of the cavity. The distance between the center of the bar to the end of the cavity at the heel of the iron decreases from the less lofted iron through the more lofted irons.

The present invention is an improvement of the '032 patent in that it maintains the vibration dampening characteristics of the bar while permitting distribution of the weights of the bar to more desirable areas.

SUMMARY OF THE INVENTION

The present invention relates to a golf club iron having a shaft, a head having a sole, a toe end, and a heel end, with the head being attached to one end of the shaft. The head comprises a substantially planar striking face with a cavity in the back portion of the club opposite the striking face. This cavity extends between the toe end and the heel end of the head. A vibration dampening ramp bar is placed within the cavity, with the top end of the ramp bar being adjacent the lower edge of the cavity, and the lower end of the ramp bar terminating substantially short of the upper edge of the cavity. The center of mass, or center of gravity, of the club head is located substantially in the middle of the club striking face and is not in alignment with the center of the ramp bars.

DETAILED DESCRIPTION OF THE PREFERRED EMBODIMENT

Figure 1:
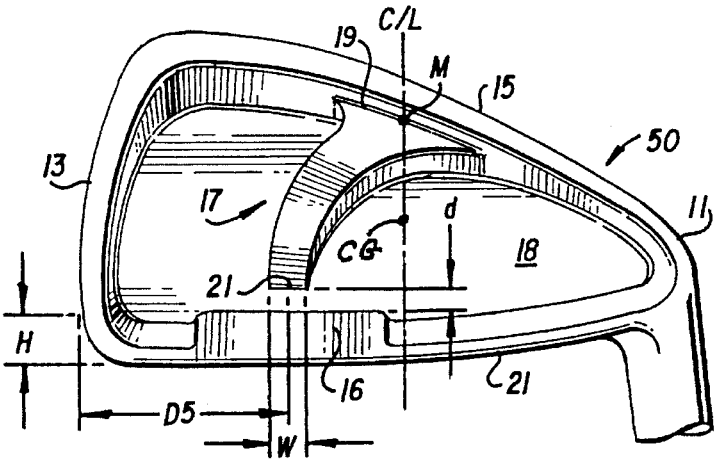
FIG. 1 illustrates the club head of the present invention, specifically a 5-iron.

Referring to FIG. 1, there is shown club head 50 which, in the particular illustration, is a 5-iron in the set of clubs of the present invention. Club head 50 includes heel 11, toe 13, and sole 15. A flat name-embossed area 16 lies adjacent the top of the club head and extends into cavity 18.

Vibration dampening ramp bar 17 extends within said cavity. Top 19 of the ramp bar, which is the thickest part of the bar, is adjacent the cavity edge of the sole of the club. Ramp bar 17 extends downwardly and terminates at its lower end substantially short of upper edge 21 of cavity 18. In the particular embodiment shown, ramp bar 17 extends in an arcuate fashion from its upper end to its lower end.

In one specific club, the height H of insignia plate 16 equals 0.200 inch; the width W of lower end ramp bar 17 equals 0.250 inch. The distance D between the lower end of the ramp bar and insignia plate 16 is 0.100 inch. It is quite obvious, then, that the ramp bar terminates short of the insignia plate and, therefore, substantially short of the upper edge of cavity 18.

These dimensions are substantially the same for each of the irons in the set.

In each club, vertical centerline C/L of the club head passes substantially through the midpoint M of the top of the ramp bar. Generally, the center of gravity CG of the clubs lies on the C/L substantially at the center of the club head face and, therefore, is not in alignment with the center of the ramp bars. Accordingly, the center of the mass of the ramp bars is offset from the center of gravity of the club head.

Figure 2:
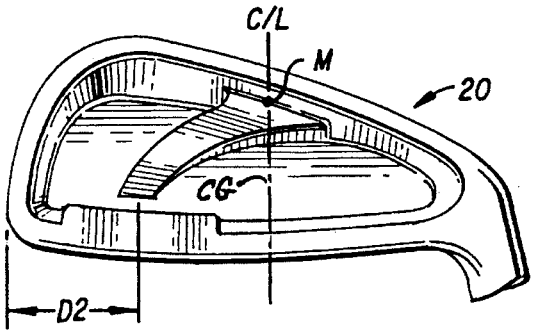
FIG. 2 is an illustration of the present invention, specifically a 2-iron.
Figure 3:
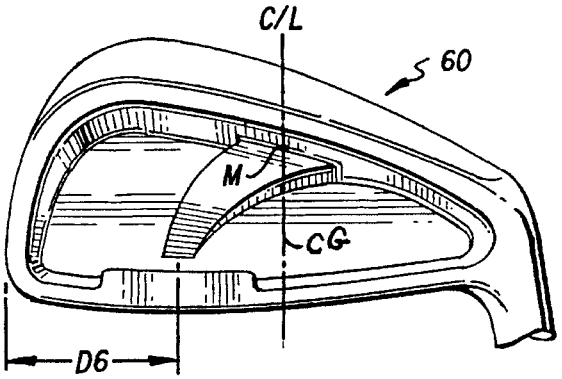
FIG. 3 is a club head of the present invention, specifically a 6-iron.
Figure 4:
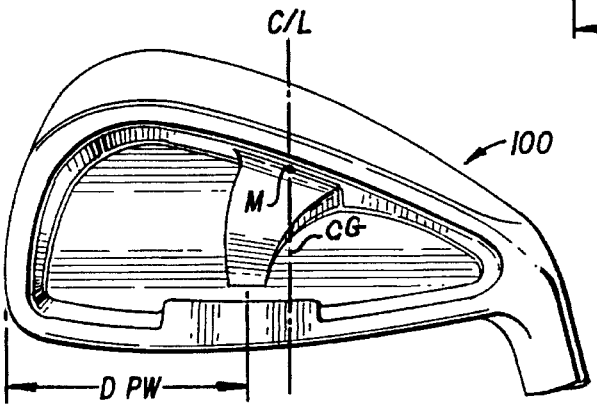
FIG. 4 is a club head of the present invention, specifically a pitching wedge.

FIG. 2 illustrates a 2-iron using the ramp bar. FIG. 3 illustrates a 6-iron using the ramp bar. FIG. 4 illustrates a pitching wedge using the ramp bar.

As can be see from these four figures, the distance between the center of lower edge 21 of ramp bar 17 and the toe end of the club varies in the irons, with such distance being less in the higher-numbered irons than in the subsequent lower-numbered irons. Thus, the distance increases as the loft of the club head increases. This applies throughout the set, even though only four clubs are shown for illustrative purposes.

In one specific example, the dimension D for the particular iron is shown in the following chart:

| IRON NO. | DIMENSION D |
|---|---|
| 1 | 1.000" |
| 2 | 1.000" |
| 3 | 1.086" |
| 4 | 1.172" |
| 5 | 1.257" |
| 6 | 1.343" |
| 7 | 1.429" |
| 8 | 1.515" |
| 9 | 1.600" |
| PW | 1.686" |
| MW | 1.686" |
| SC | 1.686" |
| LW | 1.686" |

The improvement of the present invention over that of the above-discussed patent maintains the vibration dampening characteristics of the bar, but permits positioning more of the vibration dampening bar mass lower on the face in the impact area on standard size heads. Length of the new bar is shortened and widened a bit compared to the bars of the above-mentioned '032 patent. Further, the present invention permits "deeper" or "oversized" blades and maintains the mass of vibration dampening in the impact area and lower on the face, especially for short irons.

The above description and associated drawings are illustrative only. The invention is to be limited only by the scope of the following claims:

I claim:

1. A golf club iron comprising a shaft;

a head having a sole, a toe end, and a heel end, said head being attached to one end of said shaft, said head comprising a substantially planar striking face and a back portion opposite said striking face;

a cavity in said back portion of said head, said cavity extending substantially between said toe end and said heel end of said head and having upper and lower edges and a substantially planar inner surface opposite said striking face, said lower edge being adjacent said sole; and a single vibration dampening ramp bar having a top end and a lower end within said cavity, the top end of said ramp bar being adjacent said lower edge of said cavity, said ramp bar tapering from said top end toward said inner surface, the lower end of said bar terminating in the plane of said inner surface short of said upper edge of said cavity, the center of said ramp bar being offset from the center of gravity of said head.

2. The golf club iron of claim 1 wherein said ramp bar is integral with said head.

3. The golf club of claim 1 wherein the center of said top end of said ramp bar lies substantially on the vertical centerline of said club head.

4. The golf club head of claim 3 wherein said lower edge of said cavity lies between said vertical centerline of said club and the toe end of said club.

5. A set of golf club irons including at least a first and second iron, each of said irons comprising a head having a sole, a toe end, and a heel end, said head being attached to one end of said shaft, said head comprising:

a substantially planar striking face and a back portion opposite said striking face;

a cavity in said back portion of said head, said cavity extending substantially between said toe end and said heel end of said head and having upper and lower edges and a substantially planar inner surface opposite said striking face, said lower edge being adjacent said sole; and a single vibration dampening ramp bar having a top end and a lower end within said cavity, the top end of said ramp bar being adjacent said lower end of said cavity, said ramp bar tapering from said top end toward said inner surface the lower end of said bar terminating in the plane of said inner surface short of said upper end of said cavity;

the distance between the center of said lower end of said ramp bar and the toe end of said first iron being less than the distance between the center of the lower end of said ramp bar and the toe end of said second iron, the center of said ramp bar being offset from the center of gravity of said club head.

* * * * *